United States Patent [19]

Bray

[11] 4,177,862

[45] Dec. 11, 1979

[54] SPRINKLER ARRANGEMENTS

[75] Inventor: Geddes A. Bray, Manchester, England

[73] Assignee: Mather & Platt Limited, Manchester, England

[21] Appl. No.: 891,357

[22] Filed: Mar. 29, 1978

[30] Foreign Application Priority Data

Jun. 15, 1977 [GB] United Kingdom ..... 24904/77

[51] Int. Cl.[2] ..... A62C 35/00; A62C 37/10

[52] U.S. Cl. ..... 169/17; 169/41

[58] Field of Search ..... 169/37–41, 169/17

[56] References Cited

U.S. PATENT DOCUMENTS

| | | | |
|---|---|---|---|
| 2,211,399 | 8/1940 | Winslow | 169/39 |
| 2,871,953 | 2/1959 | Bray | 169/37 |
| 3,007,528 | 11/1961 | Gloeckler | 169/41 |
| 3,584,689 | 6/1971 | Willms | 169/38 X |
| 4,083,410 | 4/1978 | Anderson | 169/37 |

FOREIGN PATENT DOCUMENTS

| | | | |
|---|---|---|---|
| 2206993 | 8/1973 | Fed. Rep. of Germany | 169/41 |
| 726236 | 3/1955 | United Kingdom | 169/41 |

*Primary Examiner*—Charles A. Marmor

*Attorney, Agent, or Firm*—Sughrue, Rothwell, Mion, Zinn and Macpeak

[57] ABSTRACT

A sprinkler arrangement comprises a sprinkler head connected via a first valve to one end of a length of connection pipework adapted for attachment to a main pipework system containing fire extinguishant. A second valve is arranged at the other end of the connection pipework and comprises an inert plug which is maintained in a valve closed position by a strut which contacts the first valve. On opening of the first valve, for example when a predetermined temperature is reached, the strut is caused to move and thereby permit movement of the inert plugs to allow a flow of extinguishant into and through the connection pipework to the sprinkler head when the arrangement is attached to the main pipework system.

6 Claims, 1 Drawing Figure

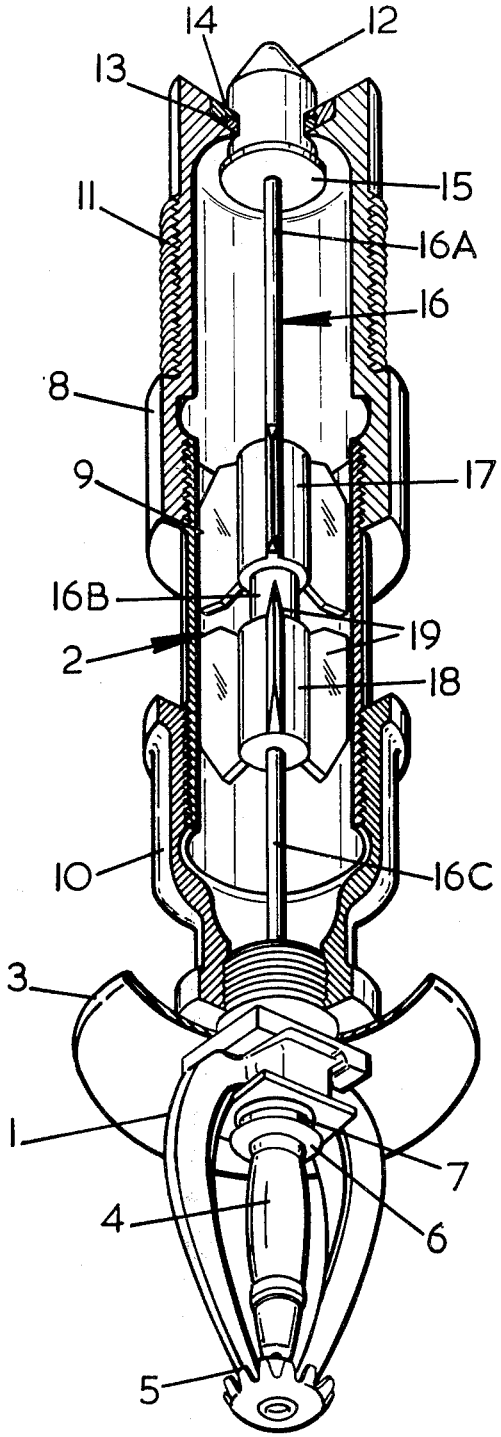
14
12
13
15
11
16A
16
8
17
9
16B
19
2
18
10
16C
3
1
7
4
6
5

SPRINKLER ARRANGEMENTS

The present invention relates to fire extinguishing sprinkler arrangements and in particular to pendent type sprinkler arrangements which are designed for use in freezing conditions.

It will be realised that the fire protection of premises such as cold storage warehouses where freezing conditions present a hazard cannot be effected by the usual systems of pipework and sprinklers as would be used for protection of premises at normal temperatures owing to the freezing of water or other extinguishant in the pipework. Conventionally, premises such as these are protected by so called pendent type sprinklers in which a conventional sprinkler head is suspended from, for example, a false ceiling within the premises and a length of pipework filled with air or other non-freezing fluid connects the sprinkler head to the main pipework containing the extinguishant. Activation of the sprinkler head to open a valve between an outlet of the sprinkler and the connecting length of pipework additionally causes the opening of a second valve between the main pipework and the connecting pendent pipework to permit egress of the extinguishant.

With conventional arrangements, problems are encountered with the opening mechanism of the second valve which often sticks or becomes fixed in position owing to corrosion or the deposit of dirt or other foreign bodies around the valve member or release mechanism.

The object of the present invention is to provide an improved pendent sprinkler arrangement which obviates or substantially mitigates the aforementioned problem.

According to the present invention there is provided a sprinkler arrrangement comprising a sprinkler head connected via a first valve to one end of a length or connection pipework adapted for attachment to a main pipework system containing a fire extinguishant, a second valve being arranged at the other end of the connection pipework and comprising an inert plug maintained in a valve closed position by a strut which contacts the first valve, opening of the first valve causing movement of the strut and thereby permitting movement of the inert plug to allow a flow of extinguishant into and through the connection pipework to the sprinkler head when the arrangement is attached to the main pipework system.

An example of the present invention will now be described with reference to the accompanying drawing which is a side perspective view of a sprinkler arrangement partially cut away to reveal the internal structure thereof.

The sprinkler arrangement comprises a sprinkler head connected to a length of connection pipework 2 for attachment to a main pipework system (not shown) containing fire extinguishant. The sprinkler head 1 is adapted to depend from the ceiling of premises wherein there exists freezing conditions and a masking ring 3 is provided between the sprinkler head 1 and the connection pipework 2 to cover the aperture in the ceiling through which the sprinkler head 1 projects. The connection pipework 2 is intended, therefore, to isolate the sprinkler head 1 from the main pipework system which contains, for example, water which would freeze if positioned in close proximity to the sprinkler head 1. The interior of the pipework 2 can contain simple air—a dry pendent type sprinkler arrangement, or contain a liquid which freezes at a temperature lower than that maintained in the premises to be protected. For example, glycerine could be used for temperature conditions around 0° C.

The sprinkler head 1 can be of a known type such as that shown comprising a frangible bulb 4 containing a liquid, which bulb 4 will shatter on attainment of a predetermined temperature level, and a deflector 5 to produce a spray of the fire extinguishant. The bulb 4 maintains a valve comprising a valve disc 6 in position closing an extinguishant outlet bore through the sprinkler head 1 which connects with the interior of the pipework 2 in known manner. The valve seat 7 is provided a vee slot (not shown) which allows any condensation that may accumulate within the pipework 2 to disperse and also prevents a build-up of ice forming in the bore of the sprinkler head 1 which would impair the operation of the arrangement in the event of a fire.

The sprinkler head 1 is screw connected to the pipework 2 which comprises three separate sections, 8, 9, 10 of pipe which are also screw connected. This screw connection permits the length of the pipework 2 to be varied as desired. The upper pipe section 8 is externally screw threaded as at 11 to allow the sprinkler arrangement to be attached to the main pipework system and it will be realised that the uppermost part of pipe section 8 will project into the main pipework and stand proud of the entry point therein.

The upper end of section 8 is closed by a second valve which comprises an inert, substantially cylindrical plug 12. Fitted around the plug 12 in the section 8 is a sealing ring 13 located in a seal housing 14 which maintains the pipework 2 in a fluid-tight condition with respect to the main pipework. The plug 12 is made of an inert substance such as polytetrafluoroethylene (P.T.F.E.) so as not react with the fire extinguishant in contact with it or perish over a long period of time when fitted in position.

The plug 12 is held in position against the pressure of the fire extinguishant by a disc 15 into a blind hole of which is fitted a strut 16. The strut 16 is composed of three parts 16A, 16B, 16C spaced axially along the pipework, and the lowermost part 16C engages the valve disc 6. The strut 16 can merely abut the valve disc 6 or be connected or integrally formed therewith. The central part 16B may be adjusted in length to accommodate variable lengths of the pipework 2 and the accuracy of match required is minimal because of the ability of the plug 12 to seal anywhere along its cylindrical length against the sealing ring 13.

A pair of bladed spacers 17 and 18 maintain the strut 16 axially within the pipework and guide the movement of same on operation of the arrangement. The spacers 17 and 18 are normally accommodated within the intermediate pipe length 9 of the pipework but on operation of the arrangement of the lowermost spacer 18 retains the strut part 16C within the pipework 2. The blades 19 of the spacer 18 are tapered at their lower edges and these can rest within the lowermost portion of pipe section 10. The particular bladed construction of the spacers 17 and 18 is important as extinguishant flow should ideally be unimpeded through the pipework 2. Similarly, the positioning of the strut 16 along the axis and the spray of the extinguishant on operation of the arrangement.

As previously mentioned, when a predetermined temperature value is attained, the bulb 4 will shatter removing the support for the valve disc 6 which if separate from the strut 16 will fall away opening the valve. Simultaneously, the strut 16 will also fall and be retained partially depending axially through the bore of sprinkler head 1 by the spacer 18. The plug 12, now no longer restrained in position by the strut 16 will be depressed by fire extinguishant pressure from above to permit the extinguishant to flow into the pipework 2 and thence to be deflected by the deflector 5 into a spray discharging onto the seat of the fire.

What is claimed is:

1. A sprinkler arrangement, comprising:

(a) a sprinkler head operable on attainment of a predetermined temperature;

(b) at least two interconnected pipe sections comprising a length of connection pipework to one end of which pipework the sprinkler head is attached and the other end of which defines a valve seat and is adapted for attachment to a main pipework system, and which pipe sections are relatively adjustable to vary the length of the connection pipework;

(c) an inert plug of resilient material which is located in the valve seat and which is substantially cylindrical in shape so that it can form a fluid-tight seal with the valve seat when located therein anywhere along its cylindrical length; and (d) a strut in the form of a rod located along the length of the connection pipework between the inert plug and the sprinkler head to maintain the plug in a sealing relationship with the valve seat anywhere along the cylindrical length of the latter whereby the sprinkler head is not overloaded by the force of the strut pressing thereon;

attainment of said predetermined temperature causing operation of the sprinkler head permitting movement of the strut and thereby movement of the inert plug out of the valve seat to allow a flow of extinguishant into and through the connection pipework to the sprinkler head when the arrangement is attached to the main pipework system.

2. An arrangement as claimed in claim 1, in which the connection pipework is adapted for attachment to a main pipework system such that a portion of the pipework may project into the pipework system, and the second valve be upstanding from the entry point of the connection pipework into the main pipework system.

3. An arrangement as claimed in claim 1, in which the strut is guided by at least one spacer so as to be movable axially within the connection pipework.

4. An arrangement as claimed in claim 3, in which each spacer is provided with a plurality of blades whereby on operation of the arrangement the strut is retained by the blades at least partially within the connection pipework.

5. An arrangement as claimed in claim 1, in which the valve seat comprises a sealing ring located in a seal housing.

6. An arrangement as claimed in claim 1, in which the inert plug is made of polytetrafluoroethylene (PTFE).

* * * * *